United States Patent [19]

Anderson

[11] Patent Number: 4,813,089

[45] Date of Patent: Mar. 21, 1989

[54] ELECTRICIAN'S HAMMER

[76] Inventor: Richard A. Anderson, 13024 Kerrydale Rd., Woodbridge, Va. 22193

[21] Appl. No.: 208,460

[22] Filed: Jun. 20, 1988

[51] Int. Cl.[4] ..... B25F 1/00

[52] U.S. Cl. ..... 7/143; 7/164; 81/489

[58] Field of Search ..... 7/122, 143, 146, 147, 7/164; 81/20, 45, 46, 489

[56] References Cited

U.S. PATENT DOCUMENTS

| | | | |
|---|---|---|---|
| 1,419,567 | 6/1922 | Johnson | 81/20 |
| 2,966,745 | 1/1961 | Erickson | 7/122 |

*Primary Examiner*—Roscoe V. Parker

*Attorney, Agent, or Firm*—Zarley, McKee, Thomte, Voorhees & Sease

[57] ABSTRACT

An electrician's hammer that has a hammer head and a hammer handle. The rear end of the handle is notched to provide a notch which has a width transverse to the longitudinal axis of the handle hammer corresponding to the thickness of drywall. This allows electrical boxes to be easily set out a distance from the studs equal to the drywall.

5 Claims, 1 Drawing Sheet

ELECTRICIAN'S HAMMER

BACKGROUND OF THE INVENTION

This invention relates to a hammer. Particularly, it relates to a hammer adapted for easy use by electricians.

Electricians must set electrical boxes for electrical plug outlets, and as well switch boxes. Typically, these boxes are set at a uniform height throughout a house and thus there must be a convenient way of measuring the height for the boxes. These boxes must also be outset from the wall studs a sufficient distance in order to allow for the thickness for drywall which is placed in covering relationship over the studs. When this is properly done the electrical and/or switch box will appear flush with the drywall, because the outset is a thickness equal to the drywall thickness from the stud to which the box is nailed.

The setting of the proper distance, both in terms of height and also of the outset from the drywall are time-consuming. Not only are they time-consuming, but also it is often hit or miss, particularly with setting of the proper outset dimension to compensate for drywall thickness.

It, of course, goes without saying that one could use a tape measure and measure each box and thereafter attach it. However, measuring each box necessarily is time-consuming, and significantly increases the number of hours to properly wire the home, or other new construction. It therefore can be seen that there is a real and continuing need for a device which allows for proper measurement of electrical boxes, both from the standpoint of height and from the standpoint of the outset from the wall stud. This invention has as its primary objective the fulfilling of this need.

SUMMARY OF THE INVENTION

The invention comprises a hammer particularly adapted for use by electricians. The hammer has a conventional head and a conventional handle portion, with the handle portion having a special adaptation. The special adaptation is a notched end which provides a notch that has a width corresponding to the thickness of drywall. This allows electrical and switch boxes to be easily set without the need for separate measuring instruments.

DETAILED DESCRIPTION OF THE INVENTION

Figure 1:
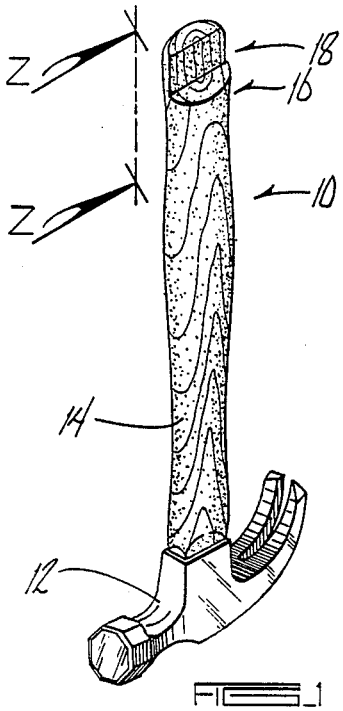
FIG. 1 is a perspective view of the electrician's hammer of this invention.
Figure 2:
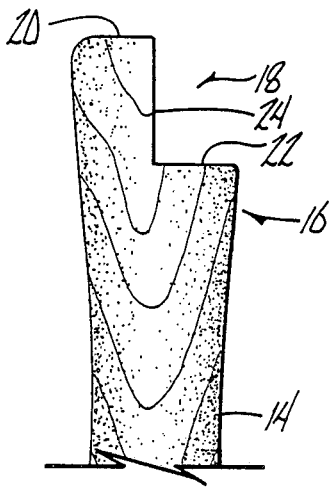
FIG. 2 a side view of the handle showing the notched end.

Referring first to FIG. 1, the hammer 10 comprises a hammer head 12 and a hammer handle 14. Handle 14 terminates in a rear end portion 16. End portion 16 defines a notch referred to generally at 18. Notch 18 is made by a cutout from the rear end 20 of the hammer.

Notch 18 has a shoulder which is defined by bottom surface 22 and interior wall surface 24, which join together to define notch 18. The width of notch 18 transverse to the longitudinal axis of handle 14 is adjusted to provide a shelf which corresponds in thickness to the thickness of drywall which is to be attached to conventional drywall studs. Typically, this will be $\frac{1}{2}$ inch, $\frac{5}{8}$ inch, or $\frac{3}{4}$ inch drywall.

Figure 4:
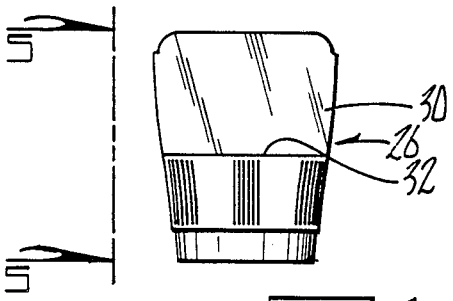
FIG. 4 shows an adaptation piece which may be added to the end of a conventional hammer.
Figure 5:
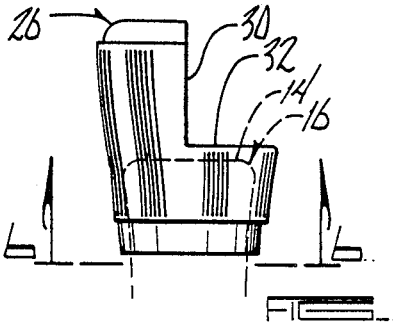
FIG. 5 shows a side view of the adaptation piece of FIG. 4.
Figure 6:
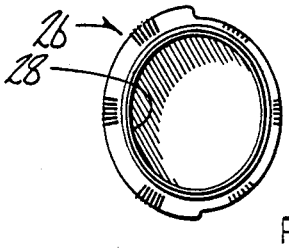
FIG. 6 an end view of the adaptation piece of FIG. 4.

FIGS. 4, 5 and 6 show an alternative embodiment in which the notch is not made as an integral part of the hammer handle 14, but is instead provided in a separate and distinct piece (FIG. 4) which is attached to the bottom or rear end 20 of a conventional hammer. The piece of FIG. 4 can be a single piece molded from stretchable polymeric plastic materials such as polyethylene or polypropylene. Piece 26 is simply slipped over the end of a hammer, and thereafter defines a notch similar to notch 18. Piece 26 has an open top 28, a rear notch wall 30, and a bottom notch wall 32, which join together to define a notch exactly corresponding to notch 18. Piece 26 is simply slipped onto the end of a hammer via opening 28, and since it is a polymeric plastic material it grips the end of the hammer and releasably attaches thereto, similar to the way handlebars attach to a bicycle. It therefore allows use of typical and ordinary hammers without having to create a separate and distinct notch in the end as shown in FIG. 1.

Figure 3:
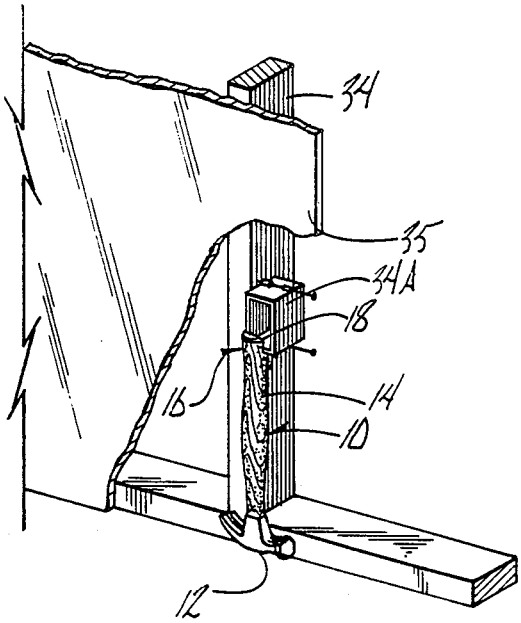
FIG. 3 shows how the hammer of FIG. 1 can be used to properly set out an electrical box from the wall a thickness corresponding to drywall thickness.

In actual use, the device of the invention can be used as illustrated in FIG. 3. Height from the floor for example for an electrical box 34A is determined by placing the head of the hammer along the floor and determining a uniform height up from the bottom of the floor, corresponding to the length of the hammer together with the head thickness. This usually is about 13" for a typical hammer. The outset of the box from the wall 35 is determined in the manner illustrated in FIG. 3. The notch is presented in facing relationship to the wall stud and the hammer parallel to its longitudinal axis is placed against the stud. The box is inserted behind the stud adjacent to one wall of it and moved forward until it comes flush against surface 24. Thus, the box is automatically set out from the wall a width equal to the thickness of surface 22. In this manner the box will be quickly and easily outset a thickness corresponding to the drywall thickness. If a conventional hammer is used without cutting a notch, a piece such as shown in FIG. 4 is simply attached to the end of the hammer. It thus can be seen that the invention accomplishes all of its stated objectives without the need for the electrician carrying separate tools which must be used in a time-consuming manner. Instead, the electrician simply has to use the hammer, which he must use anyhow to nail the box to the wall studs. Considerable time saving is therefore achieved.

What is claimed is:

1. An electrician's hammer, comprising:

a hammer head and attached to said head a hammer handle;

said handle having a rear end portion having a rear end;

said end being notched to provide a notch which has a width corresponding to the thickness of drywall to allow electrical boxes to easily be set out a distance from the studs equal to the thickness of said drywall.

2. The hammer of claim 1 wherein said notch is cut about $\frac{3}{4}$" down along the long axis of said handle portion and has a thickness transverse to the longitudinal axis of said handle of about ½ inch thickness.

3. The hammer of claim 1 wherein said notch is an integral part of said hammer handle.

4. The hammer of claim 1 wherein said notch is provided by a releasably attachable, notched end cap.

5. A method of setting electrical boxes and switch boxes so that said boxes may be quickly and easily set at a predetermined height and at a set-out height from wall studs equal to the thickness of drywall, comprising:

setting the height of the electrical box by measuring a set distance along the longitudinal axis of a hammer;

said hammer having a head and attached to said head a hammer handle, said handle having a rear end portion having a rear end, said rear end being notched to provide a notch which has a width corresponding to the thickness of drywall to allow electrical boxes to easily be set out a distance from the studs equal to the thickness of said drywall;

determining the distance to set said box out from the stud by laying said hammer against said stud with said notch facing said stud, and resting said box on said notch flush against said handle to determine the proper thickness of its outset to compensate for drywall thickness.

* * * * *